US005238013A

United States Patent [19]

Battiston et al.

[11] Patent Number: 5,238,013

[45] Date of Patent: Aug. 24, 1993

[54] WALKING AID CANE

[75] Inventors: Joseph D. Battiston; Joseph Battiston, both of Chester; David Battiston, Midlothian, all of Va.

[73] Assignee: Tubular Fabricators Industry, Inc., Petersburg, Va.

[21] Appl. No.: 746,238

[22] Filed: Aug. 15, 1991

[51] Int. Cl.[5] ..... A45B 1/00

[52] U.S. Cl. ..... 135/75; 135/77; 135/82

[58] Field of Search ..... 135/75, 77, 78, 65, 135/68, 69, 82, 86, 80, 81

[56] References Cited

U.S. PATENT DOCUMENTS

| | | | |
|---|---|---|---|
| 3,289,685 | 12/1966 | McCall Parker | 135/77 X |
| 4,044,784 | 8/1977 | Smith | 135/75 X |
| 4,601,302 | 7/1986 | Breen et al. | 135/78 X |
| 4,947,882 | 8/1990 | Levasseur | 135/77 X |

FOREIGN PATENT DOCUMENTS

| | | | |
|---|---|---|---|
| 1181795 | 2/1970 | United Kingdom | 135/77 |

*Primary Examiner*—David A. Scherbel
*Assistant Examiner*—Lan M. Mai
*Attorney, Agent, or Firm*—Klauber & Jackson

[57] ABSTRACT

A walking aid cane comprising a base plate having an undersurface and an opening extending through the base plate; a substantially U-shaped reinforcing plate comprised of a central plate and two substantially parallel leg plates connected together by the central plate, the leg plates each having a free edge positioned adjacent to the undersurface of the base plate, and the central plate having an opening; an upright support including a lower end extending through the openings of the base plate and the central plate and connected to the base plate and the central plate thereat, respectively, and an upper end having a handle for permitting the user to grasp the cane; and a plurality of legs for supporting the cane on a surface, the plurality of legs being connected to the substantially U-shaped reinforcing plate at outer surfaces of the leg plates and being connected to the undersurface of the base plate such that the legs are in spaced relation to the upright support.

47 Claims, 3 Drawing Sheets

WALKING AID CANE

BACKGROUND OF THE INVENTION

This invention relates generally to invalid devices and, more particularly, is directed to a walking aid cane.

Various people, such as disabled and elderly people, require the aid of an invalid device to walk. Many types of invalid devices are known, such as walkers, canes and the like.

One problem with conventional walking canes, however, is that there is a single leg for supporting the cane on a ground surface, thereby providing some instability. Accordingly, canes having a plurality of legs have been developed over the years, the most common type using four legs and being generally known as "quad canes". An example of such a quad cane is disclosed in U.S. Pat. No. 4,044,784 to Alfred A. Smith in which an adjustable upright tubular support extends through a base plate and is connected to the base plate thereat. A handle is provided at the upper end of the upright tubular support for permitting a user to grasp the cane. Four legs are provided beneath the base plate and are connected by brazing to both the base plate and the lower end of the upright tubular support that extends through the base plate.

With this arrangement, however, because the legs are welded by brazing to the lower end of the upright tubular support, the upright tubular support is softened or annealed, thereby weakening the structure of the cane. Further, an impact on one leg during use, will result in an egg-shaped deformation of the lower end of the upright tubular support, which further weakens the structure and also may result in the cane being off-balance. The reason for the egg-shaped deformation is that the securement at the lower end of the upright tubular support tube occurs only on diametrically opposite sides thereof where it is secured to the legs.

U.S. Pat. No. 3,289,685 to Parker discloses a walking aid cane in which the upright tubular support has its lower end eccentrically connected on the upper surface of a circular base, with four legs being connected around the periphery of the base. This device, however, does not provide adequate stability since the spacing between the legs depends on the size of the base, that is, to obtain a large spacing of the legs, there must be a large base. Also, the device is relatively complicated in construction in the cane art, and thereby relatively expensive to manufacture.

U.S. Pat. No. 3,550,602 to Hesterman discloses a walking aid in which the upright tubular support is connected near a mid-point thereof through a base, and four adjustable legs are angularly connected to the base. However, with this device, the center of gravity is very high. Therefore, the legs must be extremely large and angled with respect to each other to provide the required stability. This becomes unwieldy in use and is also difficult to manufacture.

Other devices which are less relevant than those discussed above are described in U.S. Pat. Nos. 1,802,323 to Aulmann; 2,195,034 to Miller; 2,208,195 to Paul; 2,244,869 to Everest et al.; 2,642,074 to Pedley et al.; and 2,785,731 to Welsh. These Patents were all cited as prior art in the aforementioned U.S. Pat. No. 4,044,784.

Further, quad canes have been known as early as the 1960's, for example, as sold by Edco Surgical Supply Co., Inc., of Passaic, N.J. These quad canes have been provided with an upright tubular support having a handle at the upper end thereof and four legs, connected to the lower end of the upright tubular support by connecting bars. However, these quad canes, besides being generally difficult to manufacture, have not been entirely satisfactory from a stability and integrity standpoint.

OBJECTS AND SUMMARY OF THE INVENTION

Accordingly, it is an object of the present invention to provide a walking aid cane that overcomes the aforementioned problems with the prior art.

It is another object of the present invention to provide a walking aid cane that has increased structural integrity.

It is still another object of the present invention to provide a walking aid cane that will not deform during use.

It is yet another object of the present invention to provide a walking aid cane in which the various elements are attached to each other over a larger surface area.

It is a further object of the present invention to provide a walking aid cane that permits attachment through electric welding so as not to anneal or soften the tubular members thereof.

It is a still further object of the present invention to provide a walking aid cane that provides stability over a larger area and has a very low center of gravity.

In accordance with an aspect of the present invention, a walking aid cane includes a base plate; an upright support including a lower end extending through the base plate and connected to the base plate thereat, and an upper end having handle means for permitting a user to grasp the cane; a plurality of leg means for supporting the cane on a surface; and connecting means for connecting the plurality of leg means to at least one of the base plate and the upright support, in spaced relation to the upright support, the connecting means being interposed between the plurality of leg means and the lower end of the upright support which extends through the base plate.

In accordance with another aspect of the present invention, a walking aid cane includes a base plate; an upright support including a lower end extending through the base plate and connected to the base plate thereat, and an upper end having handle means for permitting a user to grasp the cane; a plurality of leg means for supporting the cane on a surface, the plurality of leg means being connected to the base plate in spaced relation to the upright support; and reinforcing means for preventing deformation of the lower end of the upright support, the reinforcing means being connected to the lower end of the upright support extending through the base plate and to the plurality of leg means.

In accordance with still another aspect of the present invention, a walking aid cane includes a base plate having an undersurface and an opening extending through the base plate; a substantially U-shaped reinforcing plate comprised of a central plate and two substantially parallel leg plates connected together by the central plate, the leg plates each having a free edge positioned adjacent to the undersurface of the base plate, and the central plate having an opening; an upright support including a lower end extending through the openings of the base plate and the central plate and connected to the base plate and the central plate thereat, respectively, and an upper end having handle means for permitting the user to grasp the cane; and a plurality of leg means for supporting the cane on a surface, the plurality of leg means being connected to the substantially U-shaped reinforcing plate at outer surfaces of the leg plates and being connected to the undersurface of the base plate such that the leg means are in spaced relation to the upright support.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figure 1:
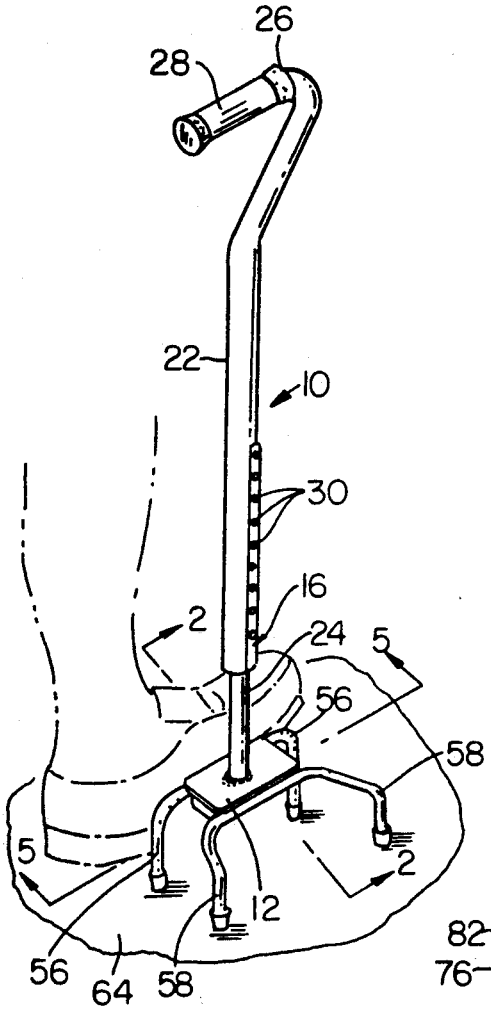
FIG. 1 is a perspective view of a walking aid cane according to a first embodiment of the present invention.

Referring to the drawings in detail, and initially to FIGS. 1-5 thereof, a walking aid cane 10 according to a first embodiment of the present invention includes a rigid metal base plate 12 having a generally rectangular configuration with dimensions of, for example, four inches by two inches. Base plate 12 includes a central opening 14 therein.

An upright tubular support 16 is mounted to base plate 12. In this regard, upright tubular support 16 includes a lower end 18 extending through opening 14 in base plate 12 by approximately one-half inch, and is connected thereat by means of electric welding 20 which extends entirely around lower end 18 at opening 14. Instead of electric welding herein, brazing can be used according to the prior art, although electric welding is better and is preferred.

As shown, and as is conventional, upright support 16 includes an outer telescoping tubular member 22 and an inner telescoping tubular member 24, with inner telescoping member 24 being slidably and telescopically received within outer telescoping member 22, whereby the height of cane 10 can be adjusted for the particular user, as will be described hereinafter. It will be appreciated that lower end 18 is formed at the lower end of inner telescoping member 24.

Further, outer telescoping member is bent at its upper end to provide a substantially horizontal handle 26 having a grip 28 made of rubber or the like thereon which the user grasps.

Figure 2:
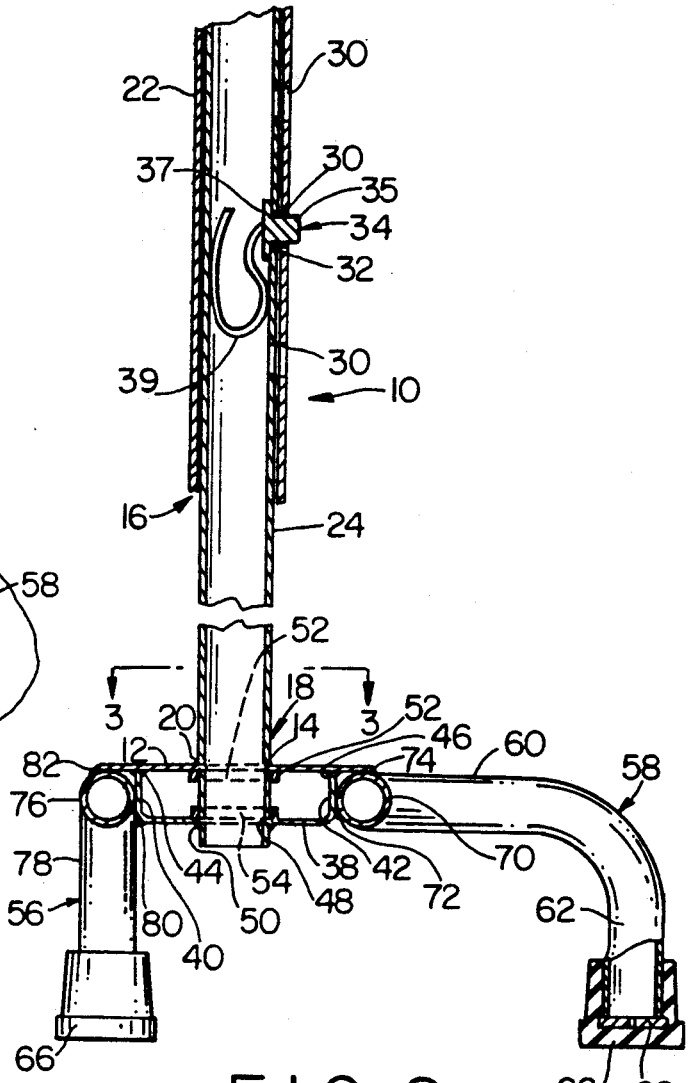
FIG. 2 is a longitudinal cross-sectional view of a portion of the walking aid cane of FIG. 1, taken along line 2—2 thereof.
Figure 5:
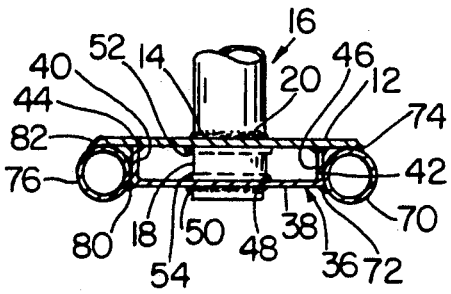
FIG. 5 is a cross-sectional view of a portion of the walking aid cane of FIG. 1, taken along line 5—5 thereof.
Figure 3:
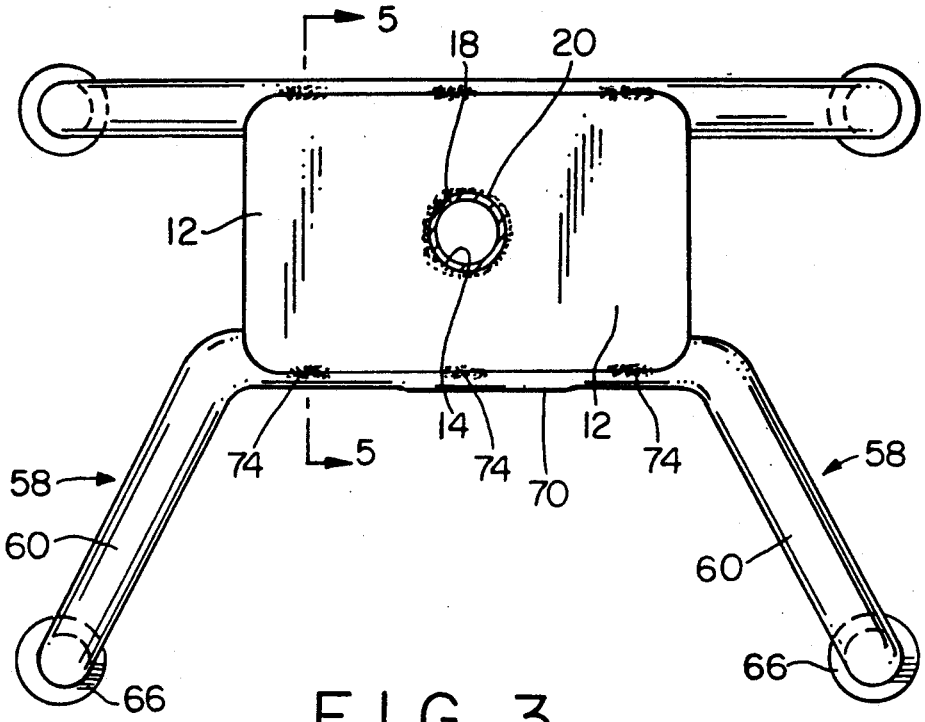
FIG. 3 is a cross-sectional view of the walking aid cane of FIG. 2, taken along line 3—3 thereof.
Figure 4:
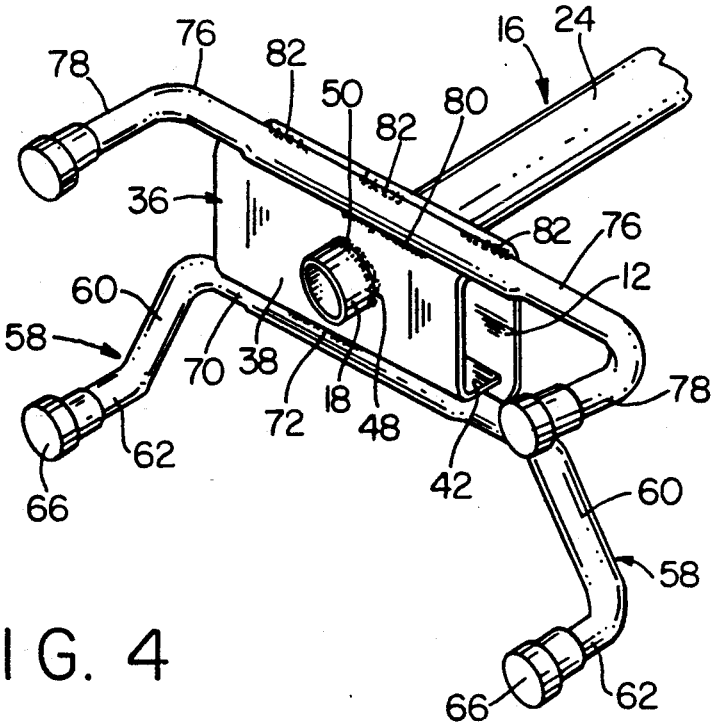
FIG. 4 is a bottom perspective view of the walking aid cane of FIG. 1.

In order to adjust the height of cane 10, outer telescoping member 22 includes a plurality of vertically aligned apertures 30 and inner telescoping member 24 is formed with a single aperture 32 which can be selectively aligned with any one of apertures 30. A push button 34 has a button section 35 which extends outwardly from aperture 32, and a base section 37 having a diameter larger than aperture 32 and which limits the outward travel of button section 35. A spring 39, which preferably functions as a leaf spring, as shown best in FIG. 2, is secured at one end thereof to base section 37 of push button 34 and the opposite end is biased against the inner wall of inner tubular member 24 opposite push button 34 so as to outwardly bias button section 35 of push button 34 through aperture 32. In this manner, base section 37 is maintained in an abutting relation against the inner wall of inner telescoping member 24.

To lock outer and inner members 22 and 24 together in a fixed relation, push button 34, and more particularly, button section 35 thereof, extends from aperture 32 of inner telescoping member 24 through one of apertures 30 to lock telescoping members 22 and 24 in a fixed relation. To adjust the height of walking cane 10, the user depresses push button 34, and more particularly, button section 35 thereof, against the force of spring 39 and out of engagement with the respective aperture 30. While maintaining push button 34 in this depressed condition, telescoping members 22 and 24 are slidably moved with respect to each other until push button 34 is aligned with another desired aperture 30 for engagement therewith. Such an arrangement is conventional as described, for example, in U.S. Pat. No. 4,616,668 to the same inventor herewith. Of course, any type of double-button mechanism such as that described in U.S. Pat. No. 4,044,784 can be used.

In accordance with an aspect of the present invention, the purpose for which will be apparent from the discussion hereinafter, a rigid metal U-shaped reinforcing plate 36 is provided and is formed with a central plate 38 which is connected, at opposite edges thereof, to a respective edge of two parallel, spaced apart leg plates 40 and 42. The opposite free edges of leg plates 40 and 42 can be electric welded, as at 44 and 46, respectively, to fixedly secure reinforcing plate 36 to the underside of base plate 12. However, in practice, it has been found that leg plates 40 and 42 need not be welded to base plate 12. In any event, a box-like structure is formed with base plate 12 and U-shaped reinforcing plate 36. It will be appreciated that with this arrangement, in normal use, base plate 12 and central plate 38 are horizontally oriented, while leg plates 40 and 42 are vertically oriented.

Central plate 38 of U-shaped reinforcing plate 36 includes a central opening 48 in axial alignment with central opening 14 of base plate 12 for receiving the lower end 18 of inner telescoping member 24 that extends through central opening 14, with lower end 18 being electric welded to central plate 38 about opening 48, as indicated at 50. In this manner, it will be appreciated that lower end 18 is doubly secured, that is, to base plate 12 and U-shaped reinforcing plate 36. However, unlike the prior art, the securement of lower end 18 occurs circumferentially therearound at openings 14 and 48.

It will be appreciated, however, that plate 36 can be flat instead of U-shaped. In such case, opposite edges would be secured to opposite legs, but not to base plate 12.

To provide further securement of lower end 18, and thereby of upright tubular support 16, the underside of base plate 12 can be provided with a circular lip 52 in surrounding relation to lower end 18 and, in like manner, the upper surface of central plate 38 of reinforcing plate 36 can be provided with a circular lip 54 in surrounding relation to lower end 18, with circular lips 52 and 54 being formed when punching out openings 14 and 48, respectively.

Walking aid cane 10 further includes four legs 56 connected to the underside of base plate 12 and to reinforcing plate 36. Specifically, there are two short inner legs 56 and two long outer legs 58, as with U.S. Pat. No. 4,044,784, the entire disclosure of which is incorporated herein by reference. Outer legs 58 each include a body portion 60 that is positioned in a generally transverse direction with respect to upright tubular support 16 and a foot portion 62 which extends downwardly from the free end of body portion 60 to contact the supporting surface 64. A rubber foot member 66 is secured to the free end of foot portion 62 of each leg 58. In addition, a flat metal disc 68 may be positioned between the lower end of foot portion 62 and rubber foot member 66 to prevent the lower end of foot portion 62 from digging into or abrading the soft material of rubber foot member 66. By reason of the soft resilient nature of rubber foot member 66, coupled with the gripping nature thereof around foot portion 62, rubber foot member 66 makes firm engagement with supporting surface 64. This prevents slippage between walking aid cane 10 and supporting surface 64 to provide a firm and positive support for an aged or infirmed user.

Further, body portions 60 are extended to form a foot connecting portion 70 which connects together the two long outer legs 58. Foot connecting portion 70 is positioned against the outer surface of leg plate 42 and against the undersurface of base plate 12 and electric welded or brazed thereat, at positions 72 and 74, respectively.

In like manner, short inner legs 56 are each formed with a body portion 76 and a foot portion 78, body portions 76 being connected with each other and extending generally transverse to the direction of upright tubular support 16 while foot portions 78 each extend downwardly from its respective body portion 76 into contact with supporting surface 64. Rubber foot members 66, as described, are also connected to the lower extremities of foot portions 78 to provide firm, non-sliding contact between foot portions 78 and supporting surface 64. Unlike long outer legs 58, short outer legs 56 do not include any foot connecting portion, but rather, body portions 76 of both short inner legs 56 are integrally formed with each other and extend along the lengthwise edge of base plate 12. Specifically, the continuous body portions 76 are positioned on the outer surface of leg plate 40 and at the undersurface of base plate 12 and electric welded thereat, as at 80 and 82, respectively.

Although foot portions 62 and 78 are shown substantially parallel to upright support 12, it will be appreciated that foot portions 62 can be angled outwardly for better stability.

With the above arrangement, legs 56 and 58 are connected to the outer edges of the underside of base plate 12, in spaced relation to upright tubular support 16. This is accomplished by means of U-shaped reinforcing plate 36. As a result, lower end 18 of upright tubular support 16 can be welded around its entire circumference to both base plate 12 and U-shaped reinforcing plate 36. This prevents lower end 18 from being deformed into the aforementioned egg shape due to impact forces when in operation. Further, because of this arrangement, welding can occur over a larger surface area so as to provide increased strength, and additionally, because a larger surface area is used, electric welding, rather than brazing can be used. Since electric welding uses less heat than brazing, there is less or no softening or annealing of the various tubes than with brazing, thereby adding to the structural integrity of walking aid cane 10. Still further, by using U-shaped reinforcing plate 36, legs 56 and 58 can be secured over a larger area than achieved with the prior art, such as disclosed in U.S. Pat. No. 4,044,784 which, in addition to securing the legs to the base plate, only secures the legs to opposite points of the upright tubular support.

Figure 6:
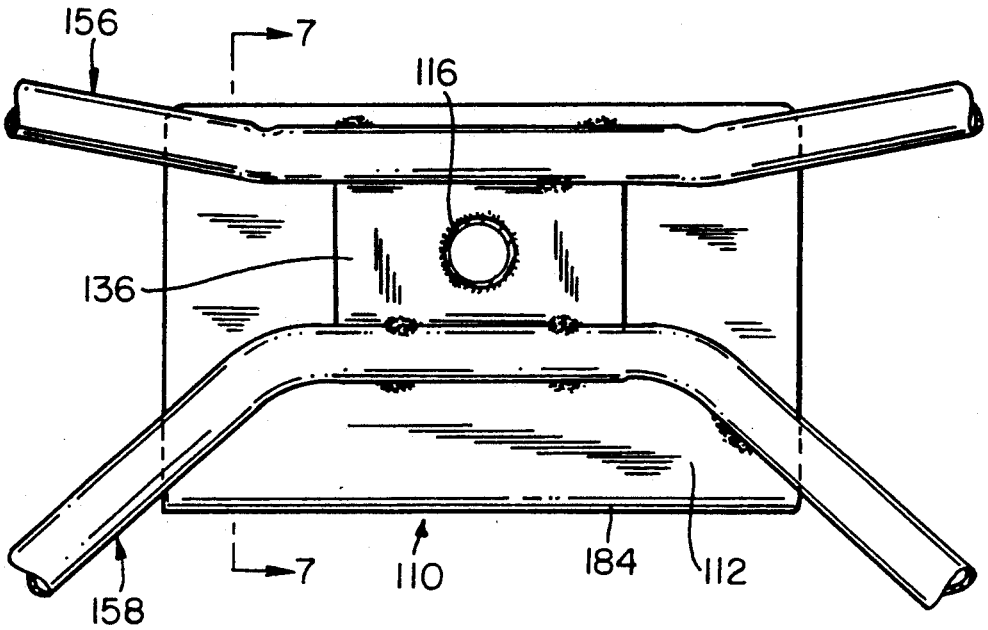
FIG. 6 is a cross-sectional view similar to FIG. 3, of a walking aid cane according to another embodiment of the present invention.
Figure 7:
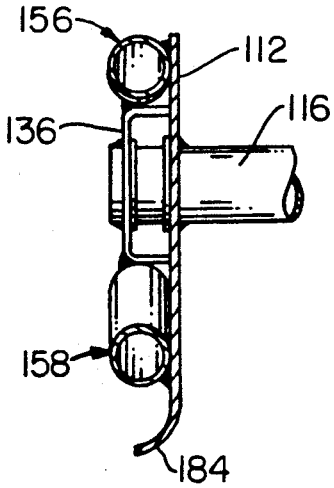
FIG. 7 is a cross-sectional view, similar to FIG. 5, of the walking aid cane of FIG. 6.

Referring now to FIGS. 6 and 7, a walking cane 110 according to an alternate embodiment of the present invention is shown, in which elements corresponding to those described above with respect to walking aid cane 10 are identified by the same reference numerals augmented by 100, and a detailed description of the common elements will be omitted herein for the sake of brevity.

Specifically, walking aid cane 110 is effectively identical to walking aid cane 10, but is used for a larger size walking aid cane. In this regard, base plate 112 has dimensions of approximately 3.5 inches by 6 inches, although U-shaped reinforcing plate 136 can be of substantially the same size as reinforcing plate 36 of walking aid can 10.

Further, with walking aid cane 110, the longer edge of base plate 112 adjacent long outer legs 158 can be provided with a downwardly turned lip 184 extending therealong to add further rigidity and stability to walking aid cane 110.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. A walking aid can comprising:

a base plate:

an upright support including a lower end extending through said base plate and connected to said base plate at the position of extension of said lower end through said base plate, and an upper end having handle means for permitting the user to grasp said cane;

a plurality of leg means for supporting said cane on a surface; and connecting means for connecting said plurality of leg means to at least one of said base plate and said upright support, in spaced relation to said upright support, said connecting means being interposed between said plurality of leg means and said lower end of said upright support which extends through said base plate; wherein said connecting means includes a plate means for connecting said plurality of leg means to at least one of said base plate and said upright support, in spaced relation to said upright support; and wherein said base plate includes an opening through which said upright support extends and said plate means includes an opening in alignment with said opening of said base plate and through which the lower end of said upright support extends.

2. A walking aid cane according to claim 1, wherein said base plate has a substantially rectangular configuration.

3. A walking aid cane according to claim 1, wherein said upright support includes an outer telescoping member and an inner telescoping member slidably and telescopically received within the said outer telescoping member for adjusting the height of said walking aid cane, and securement means for securing said outer and inner telescoping members in a fixed axial relation with respect to each other.

4. A walking aid cane according to claim 3, wherein said outer telescoping member has a plurality of apertures spaced and substantially aligned along the longitudinal direction of said outer telescoping member, said inner telescoping member includes an aperture adapted to be in alignment with one of said apertures of said outer telescoping member, and said securement means includes button means for engaging with said inner telescoping member and said outer telescoping member by extending through said aperture of said inner telescoping member and a selected aperture of said outer telescoping member, with an outer end of said button means extending outwardly beyond said selected aperture, and biasing means for outwardly biasing said button means such that said outer end of said button means extends outwardly beyond said selected aperture.

5. A walking aid cane according to claim 4, wherein said button means includes a button section extending through the aperture of said inner telescoping member and a base section for limiting outward travel of said button section through the aperture of said inner telescoping member, and said biasing means includes spring means within said inner telescoping member for outwardly biasing said button section through the aperture of said inner telescoping member for engagement with one of said longitudinally arranged apertures of said outer telescoping member.

6. A walking aid cane according to claim 3, wherein the lower end of said inner telescoping member constitutes said lower end of said upright support extending through said base plate and connected to said base plate, and said outer telescoping member has an upper end constituting said upper end of said upright support having said handle means thereat.

7. A walking aid cane according to claim 1, wherein said upright support includes at least one tubular member.

8. A walking aid cane according to claim 1, wherein said leg means each include a body portion secured to said substantially U-shaped plate means and a foot portion extending from the body portion into contact with the surface.

9. A walking aid cane according to claim 8, wherein each said body portion extends in a plane generally transverse to said upright support and each said foot portion is substantially parallel to said upright support.

10. A walking aid cane according to claim 8, wherein each said body portion extends in a plane generally transverse to said upright support and each said foot portion extends outwardly therefrom at an acute angle to said upright support.

11. A walking aid cane according to claim 8, wherein said body portions are further connected to said base plate.

12. A walking aid cane according to claim 8, wherein there are four leg means, the body portions of two of said leg means being connected to an outer surface of one of said leg plates of said U-shaped plate means and the body portions of the other two legs being connected to an outer surface of the other leg plate of said substantially U-shaped plate means.

13. A walking aid cane according to claim 12, wherein the body portions of two of said leg means connected to the same leg plate are longer than the body portions of the remaining two leg means and extend in a direction away from the remaining two leg means so as to constitute outer leg means of said walking aid cane.

14. A walking aid cane according to claim 12, wherein each of said leg means has a substantially identical cross-sectional configuration.

15. A walking aid cane according to claim 8, wherein each said leg means includes a resilient foot member secured to the lower end of said foot portion thereof for maximizing frictional contact between said foot portions and the surface.

16. A walking aid cane comprising:

a base plate:

an upright support including a lower end extending through said base plate and connected to said base plate at the position of extension of said lower end through said base plate, and an upper end having handle means for permitting the user to grasp said cane;

a plurality of leg means for supporting said cane on a surface; and connecting means for connecting said plurality of leg means to at least one of said base plate and said upright support, in spaced relation to said upright support, said connecting means being interposed between said plurality of leg means and said lower end of said upright support which extends through said base plate; wherein said connecting means includes a substantially U-shaped plate means for connecting said plurality of leg means to at least one of said base plate and said upright support, in spaced relation to said upright support, said substantially U-shaped plate means including substantially parallel, space apart leg plates and a central plate connected to respective edges of said leg plates; and wherein said base plate includes an opening through which said upright support extends and said central plate of said substantially U-shaped plate means includes an opening in alignment with said opening of said base plate and through which the lower end of said upright support extends.

17. A walking aid cane according to claim 1, wherein said opening in said base plate is substantially centrally positioned within said base plate and said opening in said central plate is substantially centrally positioned within said central plate.

18. A walking aid cane according to claim 16, wherein said lower end of said upright support extending through said openings in said base plate and said central plate is welded to said base plate and central plate at the respective positions of extension of said lower end through said base plate and said central plate.

19. A walking aid cane according to claim 18, wherein said welding is an electric welding.

20. A walking aid cane according to claim 16, wherein said lower end of said upright support extending through said openings in said base plate and said central plate is connected to said base plate and central plate at the respective positions of extension of said lower end through said base plate and said central plate by brazing.

21. A walking aid cane comprising:

a base plate:

an upright support including a lower end extending through said base plate and connected to said base plate at the position of extension of said lower end through said base plate, and an upper end having handle means for permitting the user to grasp said cane;

a plurality of leg means for supporting said cane on a surface; and connecting means for connecting said plurality of leg means to at least one of said base plate and said upright support, in spaced relation to said upright support, said connecting means being interposed between said plurality of leg means and said lower end of said upright support which extends through said base plate; wherein said connecting means includes a substantially U-shaped plate means for connecting said plurality of leg means to at least one of said base plate and said upright support, in spaced relation to said upright support, said substantially U-shaped plate means including substantially parallel, space apart leg plates and a central plate connected to respective edges of said leg plates; and wherein each of said leg plates has a free edge opposite to the edge attached to said central plate, said base plate has an undersurface, and said free edges of said leg plates are secured to said undersurface.

22. A walking aid cane according to claim 21, wherein said free edges of said leg plates are secured to the underside of said base plate by electric welding.

23. A walking aid cane according to claim 21, wherein said free edges of said leg plates are secured to the underside of said base plate by brazing.

24. A walking aid cane comprising:

a base plate;

an upright support including a lower end extending through said base plate and connected to said base plate at the position of extension of said lower end through said base plate, and an upper end having handle means for permitting a user to grasp said cane;

a plurality of leg means for supporting said cane on a surface, said plurality of leg means being connected to said base plate in spaced relation to said upright support; and reinforcing means for preventing deformation of said lower end of said upright support, said reinforcing means being connected to said lower end of said upright support extending through said base plate and to said plurality of leg means; wherein said reinforcing means includes a plate means for connecting said plurality of leg means to said upright support, in spaced relation to said upright support; and wherein said base plate includes an opening through which said upright support extends and said plate means includes an opening in alignment with said opening of said base plate and through which the lower end of said upright support extends.

25. A walking aid cane according to claim 24, wherein said base plate has a substantially rectangular configuration.

26. A walking aid cane according to claim 24, wherein said upright support includes an outer telescoping member and an inner telescoping member slidably and telescopically received within the said outer telescoping member for adjusting the height of said walking aid cane, and securement means for securing said outer and inner telescoping members in a fixed axial relation with respect to each other.

27. A walking aid cane according to claim 26, wherein said outer telescoping member has a plurality of apertures spaced and substantially aligned along the longitudinal direction of said outer telescoping member, said inner telescoping member includes an aperture adapted to be in alignment with one of said apertures of said outer telescoping member, and said securement means includes button means for engaging with said inner telescoping member and said outer telescoping member by extending through said aperture of said inner telescoping member and a selected aperture of said outer telescoping member, with an outer end of said button means extending outwardly beyond said selected aperture, and biasing means for outwardly biasing said button means such that said outer end of said button means extends outwardly beyond said selected aperture.

28. A walking aid cane according to claim 27, wherein said button means includes a button section extending through the aperture of said inner telescoping member and a base section for limiting outward travel of said button section through the aperture of said inner telescoping member, and said biasing means includes spring means within said inner telescoping member for outwardly biasing said button section through the aperture of said inner telescoping member for engagement with one of said longitudinally arranged apertures of said outer telescoping member.

29. A walking aid cane according to claim 26, wherein the lower end of said inner telescoping member constitutes said lower end of said upright support extending through said base plate and connected to said base plate, and said outer telescoping member has an upper end constituting said upper end of said upright support having said handle means.

30. A walking aid cane according to claim 24, wherein said upright support includes at least one tubular member.

31. A walking aid cane comprising:

a base plate;

an upright support including a lower end extending through said base plate and connected to said base plate at the position of extension of said lower end through said base plate, and an upper end having handle means for permitting a user to grasp said cane;

a plurality of leg means for supporting said cane on a surface, said plurality of leg means being connected to said base plate in spaced relation to said upright support; and reinforcing means for preventing deformation of said lower end of said upright support, said reinforcing means being connected to said lower end of said upright support extending through said base plate and to said plurality of leg means; wherein said reinforcing means; wherein said connecting means includes a substantially U-shaped plate means for connecting said plurality of leg means to at least one of said base plate and said upright support, in spaced relation to said upright support, said substantially U-shaped plate means including substantially parallel, space apart leg plates and a central plate connected to respective edges of said leg plates; and wherein said base plate includes an opening through which said upright support extends and said central plate of said substantially U-shaped plate means includes an opening in alignment with said opening of said base plate and through which the lower end of said upright support extends.

32. A walking aid cane according to claim 31, wherein said opening in said base plate is substantially centrally positioned within said base plate and said opening in said central plate is substantially centrally positioned within said central plate.

33. A walking aid cane according to claim 31, wherein said lower end of said upright support extending through said openings in said base plate and said central plate is welded to said base plate and central plate thereat.

34. A walking aid cane according to claim 33, wherein said welding is an electric welding.

35. A walking aid cane according to claim 31, wherein said lower end of said upright support extending through said openings in said base plate and said central plate is connected to said base plate and central plate thereat by brazing.

36. A walking aid cane according to claim 31, wherein each of said leg plates has a free edge opposite to the edge attached to said central plate, said base plate has an undersurface, and said free edges of said leg plates are secured to said undersurface.

37. A walking aid cane according to claim 36, wherein said free edges of said leg plates are secured to the underside of said base plate by electric welding.

38. A walking aid cane according to claim 36, wherein said free edges of said leg plates are secured to the underside of said base plate by brazing.

39. A walking aid cane according to claim 31, wherein said leg means each include a body portion secured to said substantially U-shaped plate means and a foot portion extending from the body portion into contact with the surface.

40. A walking aid cane according to claim 39, wherein each said body portion extends in a plane generally transverse to said upright support and each said foot portion is substantially parallel to said upright support.

41. A walking aid cane according to claim 39, wherein each said body portion extends in a plane generally transverse to said upright support and each said foot portion extends outwardly therefrom at an acute angle to said upright support.

42. A walking aid cane according to claim 39, wherein said body portions are further connected to said base plate.

43. A walking aid cane according to claim 39, wherein there are four leg means, the body portions of two of said leg means being connected to an outer surface of one of said leg plates of said U-shaped plate means and the body portions of the other two legs being connected to an outer surface of the other leg plate of said substantially U-shaped plate means.

44. A walking aid cane according to claim 43, wherein the body portions of two of said leg means connected to the same leg plate are longer than the body portions of the remaining two leg means and extend in a direction away from the remaining two leg means so as to constitute outer leg means of said walking aid cane.

45. A walking aid cane according to claim 43, wherein each of said leg means has a substantially identical cross-sectional configuration.

46. A walking aid cane according to claim 39, wherein each said leg means includes a resilient foot member secured to the lower end of said foot portion thereof for maximizing frictional contact between said foot portions and the surface.

47. A walking aid cane comprising:

a base plate having an undersurface and an opening extending through said base plate;

a substantially U-shaped reinforcing plate comprised of a central plate and two substantially parallel leg plates connected together by said central plate, said leg plates each having a free edge positioned adjacent to the undersurface of said base plate, and said central plate having an opening;

an upright support including a lower end extending through the openings of said base plate and said central plate and connected to said base plate and said central plate thereat, respectively, and an upper end having handle means for permitting the user to grasp said cane; and a plurality of leg means for supporting said cane on a surface, said plurality of leg means being connected to said substantially U-shaped reinforcing plate at outer surfaces of said leg plates and being connected to the undersurface of said base plate, such that said leg means are in spaced relation to said upright support.

* * * * *

UNITED STATES PATENT AND TRADEMARK OFFICE

CERTIFICATE OF CORRECTION

PATENT NO. : 5,238,013
DATED : August 24, 1993
INVENTOR(S) : Battiston et al.

It is certified that error appears in the above-identified patent and that said Letters Patent is hereby corrected as shown below:

Column 6,
Line 45, "can" should read -- cane --

Signed and Sealed this

Twenty-second Day of March, 2005

JON W. DUDAS
*Director of the United States Patent and Trademark Office*